US007041384B2

(12) United States Patent
Mittendorf

(10) Patent No.: US 7,041,384 B2
(45) Date of Patent: May 9, 2006

(54) HIGH BOND STRENGTH INTERLAYER FOR RHENIUM HOT GAS EROSION PROTECTIVE COATINGS

(75) Inventor: Donald L. Mittendorf, Mesa, AZ (US)

(73) Assignee: Honeywell International, Inc., Morristown, NJ (US)

( * ) Notice: Subject to any disclaimer, the term of this patent is extended or adjusted under 35 U.S.C. 154(b) by 132 days.

(21) Appl. No.: 10/798,642

(22) Filed: Mar. 10, 2004

(65) Prior Publication Data

US 2005/0202272 A1 Sep. 15, 2005

(51) Int. Cl.
*B32B 15/04* (2006.01)

(52) U.S. Cl. ..... 428/634; 428/655; 428/670; 428/408; 428/612; 428/941

(58) Field of Classification Search ..... None
See application file for complete search history.

(56) References Cited

U.S. PATENT DOCUMENTS

| | | | | |
|---|---|---|---|---|
| 2,778,786 A | | 1/1957 | Pearlman et al. | |
| 3,024,522 A | | 3/1962 | Cacciotti | |
| 3,703,405 A | | 11/1972 | Brenner et al. | |
| 4,119,879 A | * | 10/1978 | Devine, Jr. | 378/144 |
| 5,204,891 A | * | 4/1993 | Woodruff et al. | 378/143 |
| 5,209,388 A | | 5/1993 | Mittendorf et al. | |
| 5,577,263 A | | 11/1996 | West | |
| 5,704,538 A | * | 1/1998 | Mittendorf | 228/194 |
| 5,705,283 A | | 1/1998 | Upadhya | |
| 5,874,015 A | * | 2/1999 | Mittendorf et al. | 216/100 |
| 5,928,799 A | | 7/1999 | Sherman et al. | |
| 6,541,067 B1 | | 4/2003 | Marsh et al. | |

FOREIGN PATENT DOCUMENTS

EP 0 306 140 A1 8/1989

* cited by examiner

*Primary Examiner*—John J. Zimmerman
(74) *Attorney, Agent, or Firm*—Ingrassia Fisher & Lorenz

(57) ABSTRACT

A method for producing a coated carbon composite material is provided. The resulting coated composite is useful for applications such as rocket nozzles and valve bodies that encounter the high temperature and high flow rates in rocket propulsion and control. A carbon substrate such as graphite is first coated with rhenium. A layer of ruthenium is then deposited on the rhenium. The materials are heated at high temperature so as to melt the ruthenium. The ruthenium melts and penetrates through the rhenium layer and into pores of the carbon substrate. The rhenium and ruthenium are mutually soluble and further form a rhenium/ruthenium alloy. Upon solidification of the rhenium/ruthenium alloy interlayer, a further rhenium coating may be deposited thereon. The rhenium/ruthenium interlayer provides a high strength bond between the carbon substrate and the rhenium coating. This high strength bond achieved through use of the interlayer minimizes the problem of loss of adhesion sometimes encountered between carbon substrates and their rhenium coatings.

33 Claims, 5 Drawing Sheets

STEP 10 DEPOSIT Re LAYER

STEP 11 DEPOSIT Ru SALT LAYER

STEP 12 HEAT Ru SALT TO FORM Ru LAYER

STEP 13 HEAT Re AND Ru TO FORM ALLOY INTERLAYER

STEP 14 DEPOSIT Re OVER INTERLAYER

FIG. 1

Microphotograph of ruthenium infiltrated rhenium coating on carbon-carbon

Re-Ru phase diagram.

HIGH BOND STRENGTH INTERLAYER FOR RHENIUM HOT GAS EROSION PROTECTIVE COATINGS

FIELD OF THE INVENTION

The present invention relates to rhenium coatings. More particularly this invention relates to methods for bonding rhenium coatings over carbon substrates for use in highly erosive applications such as rocket nozzles, rocket valves, and thrust vector control valves.

BACKGROUND OF THE INVENTION

Rockets, missiles, and other rocket-propelled vehicles that travel through and outside the earth's atmosphere can experience severe operating conditions. Temperature extremes are one kind of harsh condition that vehicle design and component design must address. Temperatures in space approach absolute zero. However, certain vehicle parts, including for example, valves and nozzle bodies, which for instance are often located in the vehicle's propulsion or attitude control systems, can be subject to hot gas effluent that reaches extremely high temperatures. The temperature in rocket exhaust, for example, can reach levels greater that 5000° F. Pressures in exhaust bodies can also exceed 1000 psi.

Thus material selection is an important criteria in designing valve and nozzle components in rocket applications. Over the years, various materials have been identified which to some extent withstand the temperatures and stresses experienced by hot gas valves and nozzles. Carbon, and particularly the graphite form of carbon, for example, possesses physical properties which make it a useful construction material. Graphite demonstrates high strength and dimensional stability at elevated temperatures. Other carbon structures, such as carbon fibers in a carbon matrix, carbon-carbon, also have excellent high temperature strength. These carbon materials can be used at elevated temperatures where other refractory materials lose their practical strength.

Disadvantageously, carbon and carbon composites are susceptible to corrosion, oxidation, and erosion when exposed to oxidizing or corrosive environments. The environment in rocket exhaust gases is one kind of hostile environment that can lead to the breakdown of carbon structures. Thus it has become known in the art to use a protective coating over the surface of carbon materials exposed to rocket exhaust.

Rhenium is one metal that has been shown to successfully protect carbon materials from erosive and corrosive environments. Various methods have been practiced to form a rhenium layer over carbon-type substrates. Some known methods include electroplating and chemical vapor deposition. Rhenium metal coatings have been used in particular on carbon substrates to protect from the erosion effects of hot high speed gas flow from rocket combustions. This technology is used on rocket nozzles and thrust vector control (TVC) valve parts that require little or no dimensional change during the exposure to hot flowing gases from, for example, solid rocket motors.

The prior art methods of providing protective rhenium coatings have nevertheless experienced limitations and drawbacks. One problem that has been encountered is the loss of adhesion between the rhenium coating and the carbon substrate. Operating conditions that include thermal shock and high temperature and pressure can weaken the adhesion of the coating. As a result coverage by the rhenium coatings is sometimes lost. Rhenium coatings sometimes flake off thereby exposing the underlying carbon substrate. When this happens, the carbon substrate can be significantly and even completely destroyed by rocket exhaust. The loss of rhenium coating thus results in a reduced performance of rocket nozzle or complete loss of valve function in the TVC system.

A source of the difficulty encountered in rhenium/carbon systems is that rhenium and carbon interact. Elemental rhenium has a very high melting point. When exposed to carbon at very high temperatures, however, rhenium and carbon may interact such that carbon decreases the rhenium melting point. The lowered melting point can lead to liquefaction of the rhenium coating at the carbon/rhenium contact interface. The liquefaction thus leads to loss of adhesion and flaking of the rhenium coating.

Hence there is a need for an improved method to bond rhenium to carbon substrates and particularly carbon substrates found in rocket nozzles and TVC valves. There is a need for an improved method that provides strong adhesion between a carbon substrate and a rhenium coating. Moreover there is a need for an improved bonding method that is capable of withstanding extremely high temperatures and pressures such as those associated with rocketry environments. The present invention addresses one or more of these needs.

SUMMARY OF THE INVENTION

The present invention provides a method for bonding rhenium coatings to carbon substrates.

In one embodiment, and by way of example only, there is provided a method for making a composite material comprising the steps of: providing a carbon substrate defining a surface; depositing a first rhenium coating on the carbon substrate surface; depositing ruthenium onto the rhenium coating; heating the ruthenium in a vacuum furnace; and cooling a rhenium/ruthenium alloy. The step of heating the ruthenium may further comprise heating the ruthenium thereby causing the ruthenium to melt and further causing a rhenium/ruthenium alloy to form. The step of heating the ruthenium melts the ruthenium and allows the ruthenium to wick through pores in the first rhenium coating. Liquid ruthenium thereby penetrates into pores in the carbon substrate. Heating the ruthenium also allows a rhenium/ruthenium alloy to form through atomic diffusion. The step of depositing a rhenium coating on the carbon substrate surface further comprises using a fluoride rhenium precursor.

In another embodiment, and by way of example only, there is provided a method for making a coated carbon material comprising the steps of: providing a carbon substrate defining a surface; depositing a first rhenium coating on the carbon substrate surface using chemical vapor deposition of rhenium hexafluoride; depositing a ruthenium salt onto the rhenium coating; heating the ruthenium salt so as to leave a ruthenium layer on the rhenium coating; further heating the ruthenium layer and rhenium layer to a temperature above the ruthenium melting point; heating the rhenium and ruthenium at an elevated temperature so as to allow liquid ruthenium to wick through pores in the rhenium layer; heating the rhenium and ruthenium at an elevated temperature so as to allow liquid ruthenium to enter pores in the carbon substrate; heating the rhenium and ruthenium at an elevated temperature so as to form a rhenium/ruthenium alloy; and depositing a second rhenium coating on the rhenium/ruthenium alloy. The steps of depositing rhenium and depositing ruthenium may be selected so as to result in a rhenium/ruthenium alloy having up to 30 weight per cent ruthenium.

In a further embodiment, and by way of example only, there is provided a composite material comprising: a carbon substrate defining a surface; a rhenium/ruthenium alloy interlayer disposed on the carbon substrate surface; and a rhenium coating disposed on the rhenium/ruthenium alloy interlayer. The rhenium/ruthenium alloy interlayer may be mechanically bonded to the carbon substrate. The rhenium/ruthenium interlayer further acts to bond the rhenium coating to the carbon substrate. The carbon substrate further defines open areas and the rhenium/ruthenium alloy interlayer may be disposed at least partially within the spaces defined by the open areas. The rhenium/ruthenium alloy interlayer further defines a first surface in contact with the carbon substrate surface, and the rhenium/ruthenium alloy interlayer also defines a second surface. The rhenium layer may be deposited on the second surface of the rhenium/ruthenium alloy interlayer. The carbon substrate may comprise graphite or carbon-carbon. The rhenium/ruthenium alloy interlayer may comprise up to 30 weight per cent ruthenium.

In still a further embodiment, and by way of example only, there is provided a coated valve body comprising: a carbon substrate defining a surface; a rhenium/ruthenium alloy interlayer disposed on the carbon substrate surface, wherein the rhenium/ruthenium alloy interlayer defines a first surface in contact with the carbon substrate surface, and a second surface; and a rhenium coating is disposed on the rhenium/ruthenium alloy interlayer second surface.

In still a further embodiment, and by way of example only, there is provided a rocket nozzle comprising: a carbon substrate defining a surface; a rhenium/ruthenium interlayer disposed on the carbon substrate surface; and a rhenium coating disposed on the rhenium/ruthenium interlayer.

Other independent features and advantages of the method for bonding rhenium coatings to carbon substrates will become apparent from the following detailed description, taken in conjunction with the accompanying drawings which illustrate, by way of example, the principles of the invention.

BRIEF DESCRIPTION OF THE DRAWINGS

FIG. 1 is a flowchart showing steps in the method of forming a rhenium coated substrate with an interlayer according to one embodiment of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

It has now been discovered that a high strength bond can be achieved between rhenium coatings applied over carbon base substrates through the use of an interlayer interposed between the carbon substrate and the rhenium coating. Preferably the interlayer comprises rhenium alloyed with ruthenium. In a method of forming the interlayer, the rhenium/ruthenium alloy is formed in situ on a surface of a carbon substrate. Rhenium has a melting point of 3186° C. (5767° F.). Ruthenium has a melting point of 2334° C. (4233° F.). Carbon's melting point exceeds both at 3527° C. (6381° F.). Through judicious combination of rhenium and ruthenium, an alloy is created with a melting point close to that of rhenium. The rhenium/ruthenium alloy protects the rhenium coating from interaction with the carbon substrate. Further the rhenium/ruthenium alloy is less susceptible to weakening by carbon than is pure rhenium. Thus the rhenium/ruthenium interlayer results in a high strength bond between the rhenium coating and the carbon substrate at high temperatures and pressures.

In summary, the method of forming the rhenium/ruthenium interlayer begins with application of a first rhenium layer. A layer of ruthenium is then deposited on the exposed surface of the first rhenium layer. The materials are then heated to very high temperature so that the ruthenium is melted and converts to liquid form. A liquid phase ruthenium is thereby introduced between the carbon substrate and a rhenium coating. While in liquid form, ruthenium wicks through openings in the rhenium layer and penetrates into porosities and interstices of the carbon substrate. Further at the elevated temperature the ruthenium, through solid/liquid diffusion, alloys with the rhenium layer. Upon solidification, the ruthenium/rhenium interlayer solidifies within the porosities of the carbon substrate which results in a high strength mechanical attachment to the carbon surface. Once the rhenium/ruthenium interlayer has solidified, an additional protective coating of rhenium can be deposited on top of the interlayer.

Figure 2:
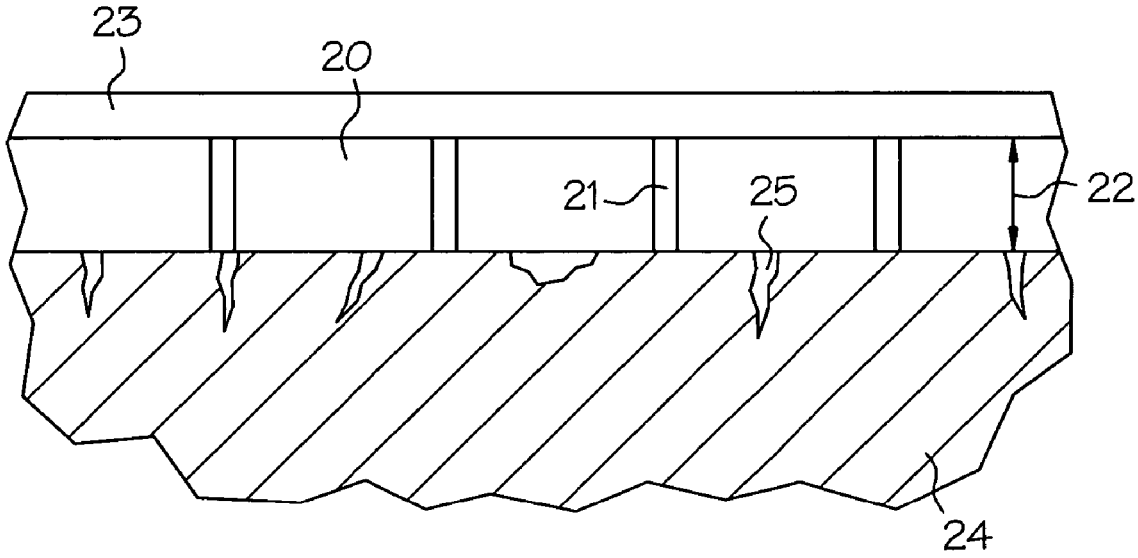
FIG. 2 is a side view of a carbon substrate, rhenium layer, and ruthenium layer at one step in the method of forming an interlayer wherein a porous rhenium layer is coated on a carbon substrate and a ruthenium overlay is further deposited on the surface of the rhenium layer.

In detail, the rhenium/ruthenium interlayer may be formed on a carbon substrate in two methods. Referring now to FIG. 1 there is shown a first method of forming a rhenium/ruthenium interlayer. The process begins with the deposition of a rhenium coating, step 10, onto a carbon substrate. The rhenium coating may be achieved through known means. However, the method is preferably one that results in the rhenium coating having porosity. As shown in FIG. 2 the first rhenium coating 20 has holes or pores 21. This porosity in the rhenium coating can be achieved through conventional chemical vapor deposition (CVD) using rhenium hexafluoride ($ReF_6$) as the precursor to provide an Re source. In such a method the carbon substrate in an evacuated vessel is heated as through radiant heating. $ReF_6$ and $H_2$ are admitted into the vessel. $H_2$ supplied in molar abundance reacts with F and is drawn off. Elemental Re is thus deposited onto the carbon substrate. U.S. Pat. No. 5,577,263, assigned to a common assignee with this application, illustrates known methods for CVD deposition of Re beginning with rhenium hexafluoride, and is hereby incorporated by reference. Re carried in the form of a chlorine precursor may also be used in this step.

While the depth 22 of this Re substrate (shown in FIG. 2) can vary, it is preferred to provide an Re substrate that is approximately 0.003 inch thick +/−0.001 inch. The process conditions such as temperatures, reaction times, and reactant concentrations for the CVD deposition of Re can vary. It has been found that the Re coating 20 that results from a fluorine precursor in a CVD process will be characterized by porosity. That is, pores 21 are present in the Re layer 20. Preferably the Re layer 20 is of a generally uniform thickness 22.

Optionally the rhenium coated surface may then be cleaned by sequential immersion in 1,1,1-trichloroethane and 2-propanol or equivalent non-polar and polar solvents.

At this stage of the process, the physical structure is a carbon substrate with a rhenium coating. The exposed surface of the carbon substrate has been coated over a desired area. There is now an exposed surface of rhenium and a second surface of rhenium that is in contact with the carbon substrate. The rhenium coating resulting from this process is characterized by a certain degree of porosity. Features such as pores, crevices, and micro cracks provide openings from the exposed surface of the rhenium to the carbon substrate.

Referring again to FIG. 1 in step 11 a layer of ruthenium salt is next deposited on the exposed surface of the rhenium coating. In one method, this itself comprises several steps. A ruthenium precursor that is water or alcohol soluble is used. A preferred precursor is a ruthenium salt, such as $RuCl_3$—$H_2O$. A water or alcohol solution of the ruthenium salt is deposited onto the rhenium coating. The solution is heated or allowed to evaporate so that the solvent is evaporated off. The deposition and evaporation may be repeated to build up a desired coating thickness. Through continued heating the chlorine and water are driven off, step 12. At this point there remains a layer of ruthenium solid on the surface of the rhenium. Preferably the amount of ruthenium is less than the rhenium, such that the thickness of the ruthenium layer is approximately 0.0005 inch thick +/−0.0001 inch.

Figure 5:
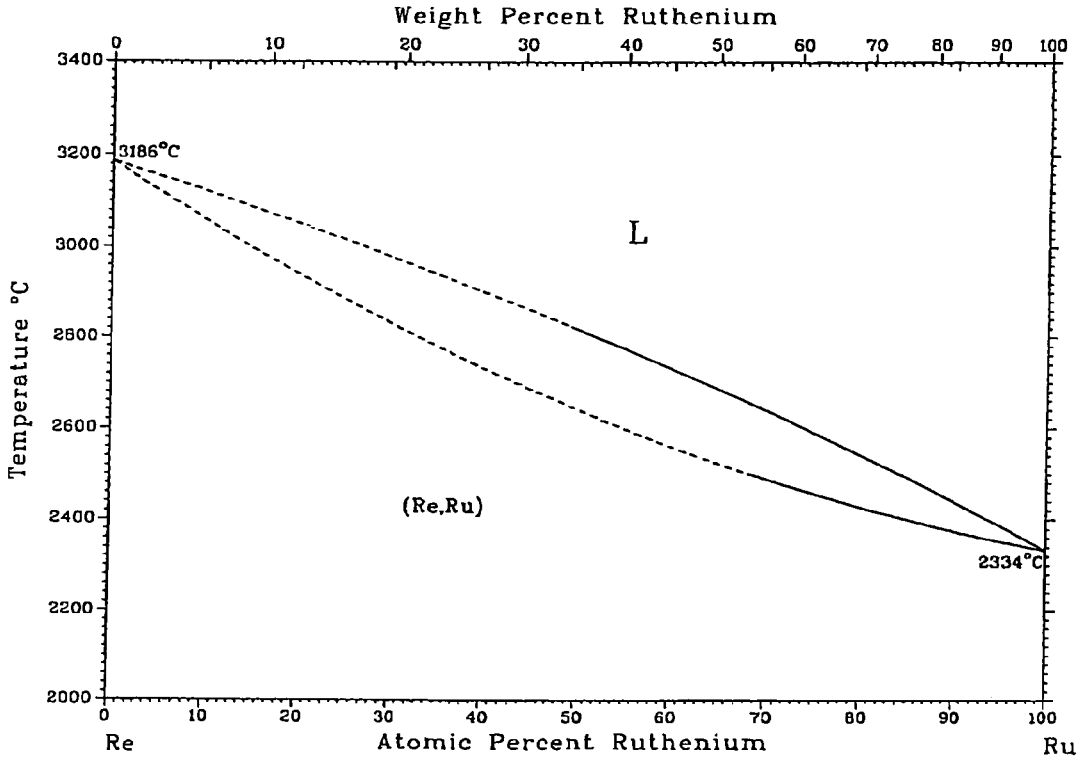
FIG. 5 is a diagram of the melting curve of the rhenium/ruthenium alloy.

The amounts of ruthenium and rhenium present at this stage of the process can determine thermal properties of the resulting alloy. The amount of ruthenium salt is selected in order to deliver a desired amount of elemental ruthenium. Further this amount of elemental ruthenium is selected in order to achieve a desired alloy composition with the amount of rhenium that has previously been deposited on the carbon substrate. This selection of alloy composition can further be guided by a desired melting point of the rhenium/ruthenium alloy. A melt curve for rhenium/ruthenium, such as shown in FIG. 5, indicates that the respective amounts of rhenium and ruthenium in the alloy affect the point at which the alloy begins to melt. In a preferred embodiment, the alloy is dilute with respect to ruthenium so that the melt point is driven close to that of rhenium.

FIG. 2 illustrates the structure at the conclusion of step 12 in the method of forming the rhenium/ruthenium alloy interlayer. Carbon substrate 24 is characterized by a number of pores 25. Pores 25 are openings, pores, voids, interstices, and spaces characteristic of carbon forms. A layer of rhenium 20 has been deposited over carbon substrate 24. The rhenium layer 20 is itself characterized by pores 21. Over the rhenium layer 20, there has now been deposited a layer of ruthenium 23. FIG. 2 (and FIG. 3) are illustrative of concepts and should not be considered scale drawings.

One preferred method for depositing ruthenium layer 23 is as follows. A generally uniform coat of ruthenium salt is first formed on the exposed rhenium surface. An eyedropper, pipette, sprayer or functionally similar device is used to deposit a layer of a solution of $RuCl_3$ and methanol onto the surface. This is done several times between intermittent drying cycles, during which the solvent evaporates. Repetition of spraying ruthenium salt and evaporation of the solvent results in an $RuCl_3$ film of about 100 micro-inch thickness accumulated on the exposed rhenium bonding surface.

In an evacuated furnace, the carbon substrate 24 with rhenium layer 20 and ruthenium layer 23 is heated from room temperature to 500° C. at a rate of 10° C. per minute. The temperature is held at 500° C. for thirty minutes, and is then increased at a rate of 10° C. per minute to 600° C., where the temperature is held for an additional period of thirty minutes. This heating process liberates the chlorine from the $RuCl_3$ layer, and leaves a ruthenium metal on the rhenium surface. Preferably this step is performed at a vacuum of at least 0.0002 torr.

Referring again to FIG. 1, the process of forming the interlayer continues with the formation of the Re/Ru alloy, step 13. In summary, the ruthenium, rhenium, and carbon are heated to beyond the ruthenium melting point. Upon melting the ruthenium liquid wicks into the pores 21 of the rhenium coating. In addition the ruthenium enters into pores 25, holes, and interstices in the carbon substrate. Atomic diffusion results in the formation of the Re/Ru alloy, which can then cool.

A preferred method for carrying out step 13 is as follows. The rhenium coated carbon substrate with the ruthenium overlay is further heated from 600° C., the temperature where the materials were at the conclusion of step 12. In an evacuated oven, the material is raised in temperature to a level between about 2400° C. to about 3100° C. Preferably the temperature can be increased at a rate of about 50° C. per minute. At a desired final temperature, the temperature is held constant for approximately fifteen minutes. This heating is performed under vacuum conditions, and preferably the vacuum is at least 0.0001 torr. At the completion of the heating process, the carbon and coating assembly is allowed to cool to room temperature.

In explanation of step 13, the carbon substrate with its rhenium and ruthenium overlays is heated to a point where the ruthenium and rhenium interact to form an alloy. Ruthenium and rhenium are mutually soluble, and a desired solubility can be achieved by heating the materials in a given ratio to a given temperature. Thus rhenium and ruthenium are heated to a point where the rhenium and ruthenium diffuse in order to form an alloy. The diffusion and alloying occurs quickly, in under 15 minutes at 2400° C. At the highly elevated temperature the diffusion process is complete so that the Re/Ru alloy is uniform. Further the Re/Ru alloy has penetrated into porosities 25 of the carbon substrate 24. And at points above the carbon substrate, in the coating, the material is also a homogeneous Re/Ru alloy.

Figure 4:
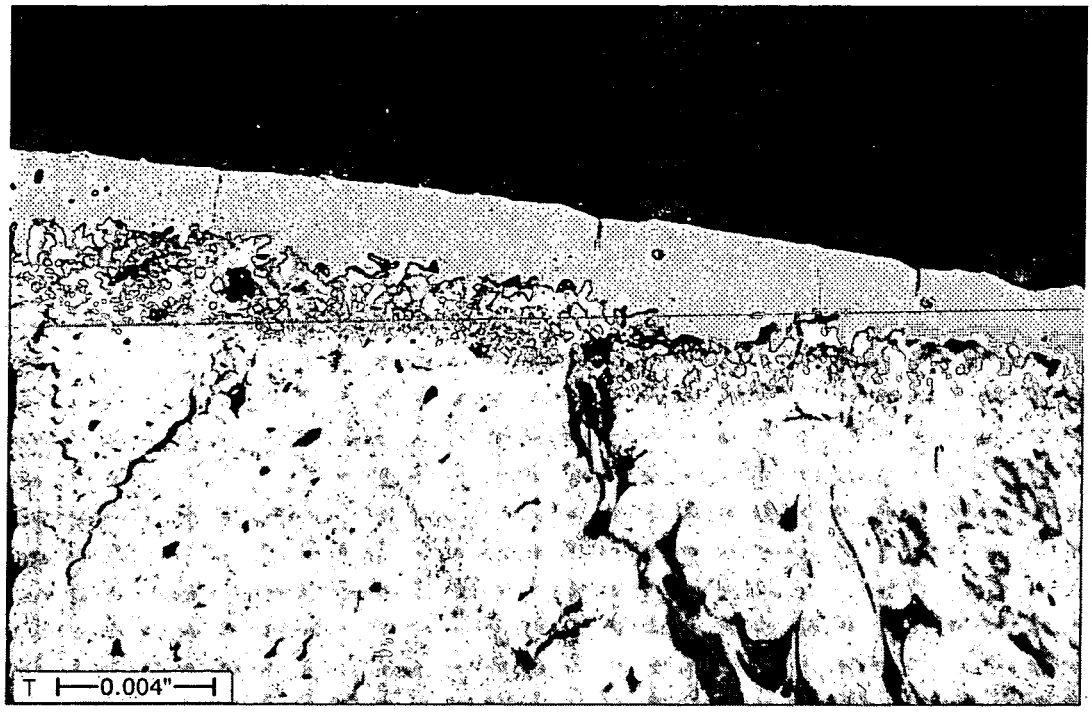
FIG. 4 is a microphotograph showing the rhenium/ruthenium alloy penetrating into pores of the carbon substrate.

Referring to FIG. 4 there is shown a microphotograph of a carbon substrate having a ruthenium infiltrated rhenium coating. FIG. 4 illustrates the porosity of the carbon substrate. The rhenium/ruthenium has penetrated into the pores and openings of the carbon substrate and is anchored thereto.

Figure 3:
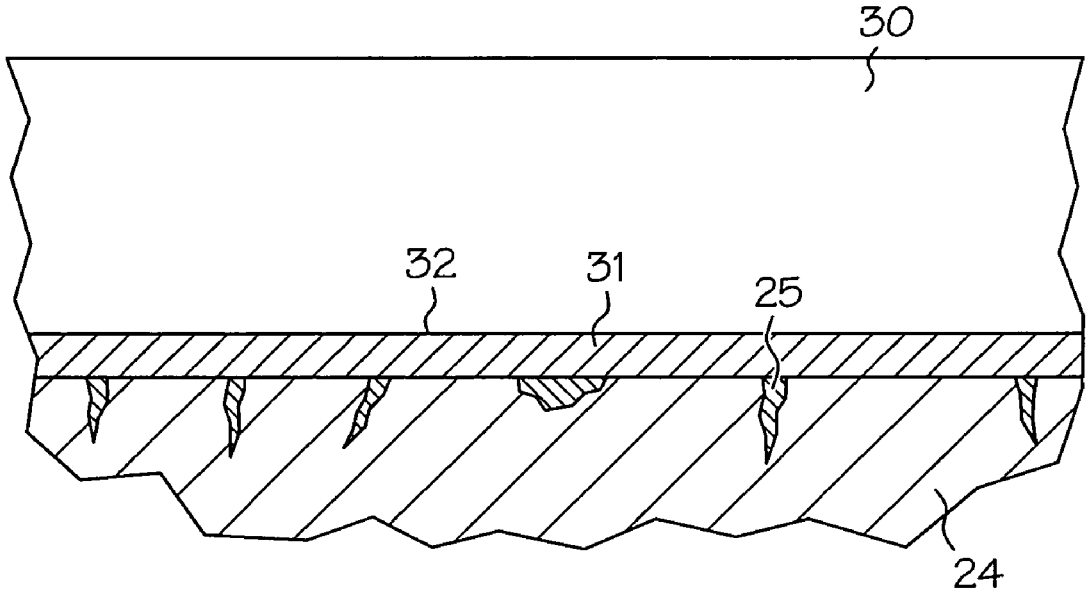
FIG. 3 is also a side view of a further embodiment of the present invention showing a rhenium coating deposited over a rhenium/ruthenium interlayer which in turn overlays a carbon substrate.

Once the Re/Ru coating has been achieved, a further coating, such as a coating of Re, can be deposited on the exposed interlayer surface, step 14. The deposition can again follow known methods for depositing rhenium. FIG. 3 illustrates a representation of a rhenium coating 30 deposited over a rhenium/ruthenium interlayer 31. The interlayer 31 is itself deposited over the carbon substrate 24. Rhenium/ruthenium alloy has penetrated within pores 25 of the carbon substrate thereby providing a multiplicity of mechanical bonding points between interlayer 31 and carbon substrate 24. Rhenium coating 30 can be of any desired thickness. The Re/Ru interlayer 31 provides a barrier between the carbon substrate 24 and rhenium coating 30. The interlayer 31 thus acts to prevent the formation of a carbon-rhenium eutectic with the associated melting point depression of rhenium.

A further process step may also be applied once the rhenium overlay has been applied on the rhenium/ruthenium interlayer. The entire metal and carbon composite may be heat treated. The additional heat treatment is done at a temperature sufficient to allow diffusion of the rhenium overlay with the rhenium/ruthenium interlayer. This diffusion heat treatment increases the adhesion strength of the rhenium coating to the rhenium/ruthenium interlayer.

At the interface 32 with the rhenium coating 30, the interlayer 31 achieves a solid solution bonding to the coating 30. The interlayer substantially increases the adhesive or bonding strength of the rhenium to the carbon, allowing for exposure of the coating to high stress from flow or thermal shock with reduced adhesion failure. The strength of the interlayer bond has been tested. The shear strength has been measured to exceed the mechanical strength of the underlying carbon substrate.

A second method may also be used to form the rhenium/ruthenium alloy interlayer. In this method a ruthenium metal layer is first deposited on a carbon substrate surface. The method of deposition may be any known method, preferably electroplating. Following deposition of a ruthenium layer, a rhenium layer is coated on the exposed surface of the ruthenium layer. Again the process may use any known method such as CVD, plasma deposition, and electroplating. Once a carbon substrate has received deposition of a ruthenium layer and above that a rhenium layer, the materials may be heated. The materials are heated in a vacuum furnace to an elevated temperature sufficient to melt the ruthenium layer. The materials are also heated and held at elevated temperature in order to permit a rhenium/ruthenium alloy to form. As before the amounts of rhenium and ruthenium are selected in order to form a specific alloy composition. Once the rhenium and ruthenium have been combined to form an alloy, the material may be cooled. A further rhenium coating may be deposited above the rhenium/ruthenium interlayer as described above. These coatings may then be diffusion treated.

FIG. 5 illustrates the metallurgical advantages of the present process. The melting point of the resulting alloy has a melting point that is between ruthenium and rhenium. Thus, while the melting point is lower than rhenium, the melting point is still high enough that there is an improved adhesion at high rocket temperatures. Preferably the Re/Ru alloy is dilute with respect to ruthenium. Therefore, as shown in FIG. 5, the alloy melting point is close to that of rhenium. Further, the alloy is homogeneous without the significant presence of discrete points of ruthenium.

EXAMPLE

The following example illustrates an embodiment of invention. A substrate of carbon-based material is selected with a matching CTE over a temperature range of interest. The CTE difference over the given temperature range should be within 15% of that of rhenium. Types of carbon that may be used as the substrate include carbon-carbon, carbon, and carbon graphite. The following steps are then performed to create a rhenium coated carbon substrate with a rhenium/ruthenium alloy interlayer.

1. The carbon substrate is cleaned with solvents to remove oils and grit from machining and handling.
2. The carbon is heated at any rate in a vacuum chamber at $10^{-3}$ torr minimum to soak between 1650° F. and 1900° F.
3. Hydrogen gas is introduced into the vacuum chamber and to the carbon at any time during heating ramp or at soak at a flow rate of 0.4 to 1.0 standard liter/minute (SLM).
4. Once the soak temperature is achieved a flow of $ReF_6$ at 10 to 25 standard cubic centimeters/minute (sccm) mixed with 0.6 to 1.5 SLM argon is introduce to the heated carbon.
5. This process is continued until such time that 0.0005 to 0.005 inches of rhenium metal is deposited.
6. The porous rhenium coating is soaked in a saturated solution of $RuCl_3.H_2O$ in either water or a polar alcohol. The solvent is allowed to evaporate. This step is repeated until the dry weight of the ruthenium salt is increased to have between about 10% to about 50% Ru metal compared to the metal rhenium coating. This process may require several steps of immersion, drying and weighing.
7. The composite is heated in a vacuum chamber to between 450° C. and 650° C. and held for a minimum of 30 minutes to allow for decomposition of the ruthenium chloride hydrated salt.
8. The composite is then heated to about 2400° C. or any temperature above 2310° C. that allows ruthenium capillary action. The heating occurs in a vacuum or in an inert gas partial pressure. At the desired point the temperature is held for a minimum of 15 minutes.
9. The composite is cooled to room temperature at any rate in the inert gas or vacuum.
10. A rhenium coating is then applied with a CVD process, or electroplated rhenium, to a thickness of about 0.005 to about 0.020 inches.
11. Diffusion treat the coatings in a vacuum furnace at 1450° C. or higher.

As stated before, the carbon substrate 24 (such as graphite) itself has a certain degree of porosity. At the micro level graphite has a noncontinuous microstructure. Certain forms of graphite, for example, are readily penetrated by many liquids and gases. The porosity of graphite and carbon substrates can be engineered so as to limit the passage of gases therethrough. However, carbon substrate surfaces retain a degree of porosity in that the surface is characterized as having pores, voids, interstices, and holes. Graphite is also characterized by having multiple layers. The presence or absence of various layers in any microregion also presents a profile of unevenness. The spaces and areas defined by these openings and unevenness are anchor points at which the interlayer can adhere and form a mechanical bond.

The above discussion has used the term carbon substrate. This term is meant to include those carbon including materials, structures, composites, and laminates that are used in formulating rocket nozzles and valve bodies, and components thereof, for use in high temperature, hot gas applications. By way of example, the term carbon substrate includes carbon, graphite, carbon-carbon, carbon tubes, carbon composites, carbon laminates, and CTE carbon substrates. The carbon substrates may take any of the various shapes and geometries needed to formulate the rocket components. Preferably a CTE carbon substrate matched to rhenium is utilized. Preferably the carbon substrate, whether graphite or carbon-carbon, should have a CTE (coefficient of thermal expansion) within 15% of rhenium.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A method for making a composite material comprising the steps of:

providing a carbon substrate defining a surface;

depositing a first rhenium coating on the carbon substrate surface;

depositing ruthenium onto the rhenium coating;

heating the ruthenium and the rhenium coating in a vacuum furnace to form a rhenium/ruthenium alloy;

cooling the rhenium/ruthenium alloy; and depositing a rhenium coating on a rhenium/ruthenium alloy interlayer.

2. The method according to claim 1 wherein the step of heating the ruthenium and the rhenium coating melts the ruthenium and thereby causes the rhenium/ruthenium alloy to form.

3. The method according to claim 1 wherein the step of heating the ruthenium and the rhenium coating melts the ruthenium and allows the ruthenium to wick through pores in the first rhenium coating.

4. The method according to claim 1 wherein the step of heating the ruthenium and the rhenium coating melts the ruthenium and allows liquid ruthenium to penetrate into pores in the carbon substrate.

5. The method according to claim 1 wherein the step of heating the ruthenium and the rhenium coating causes the rhenium/ruthenium alloy to form through atomic diffusion.

6. The method according to claim 1 wherein the step of heating the ruthenium and the rhenium coating further comprises heating the ruthenium and the rhenium coating to at least 2400° C. and maintaining that temperature for at least 15 minutes.

7. The method according to claim 1 wherein the step of depositing a rhenium coating on the carbon substrate surface further comprises depositing by chemical vapor deposition.

8. The method according to claim 1 wherein the step of depositing a rhenium coating on the carbon substrate surface further comprises using a fluoride rhenium precursor.

9. The method according to claim 1 wherein the amount of rhenium deposited and the amount of ruthenium deposited are selected so as to form a rhenium/ruthenium alloy comprising up to 30 weight per cent ruthenium.

10. A method for making a coated carbon material comprising the steps of:

providing a carbon substrate defining a surface;

depositing a first rhenium coating on the carbon substrate surface using chemical vapor deposition of rhenium hexafluoride;

depositing a ruthenium salt onto the rhenium coating;

heating the ruthenium salt so as to leave a ruthenium layer on the rhenium coating;

further heating the ruthenium layer and rhenium layer to a temperature above the ruthenium melting point;

heating the rhenium and ruthenium at an elevated temperature so as to allow liquid ruthenium to wick through pores in the rhenium layer;

heating the rhenium and ruthenium at an elevated temperature so as to allow liquid ruthenium to enter pores in the carbon substrate;

heating the rhenium and ruthenium at an elevated temperature so as to form a rhenium/ruthenium alloy; and depositing a second rhenium coating on the rhenium/ruthenium alloy.

11. The method according to claim 10 wherein the steps of depositing rhenium and depositing ruthenium are selected so as to result in a rhenium/ruthenium alloy having up to 30 weight per cent ruthenium.

12. The method according to claim 10 wherein the step of depositing a ruthenium salt farther comprises depositing a solution of $RuCl_3$ in methanol and evaporating the methanol.

13. The method according to claim 12 further comprising repeating the deposition and evaporation of $RuCl_3$ in methanol until a thickness of at least 10 microinches is achieved.

14. A method for making a composite material comprising the steps of:

providing a carbon substrate defining a surface;

depositing ruthenium metal onto the carbon substrate surface;

depositing rhenium metal onto the ruthenium metal;

heating the ruthenium metal past its melting point to form a rhenium/ruthenium alloy; and solidifying the rhenium/ruthenium alloy.

15. The method according to claim 14 wherein the step of heating the ruthenium metal further comprises heating the ruthenium metal in a vacuum furnace.

16. The method according to claim 14 wherein the step of depositing a ruthenium metal onto the carbon substrate further comprises depositing through electroplating.

17. The method according to claim 14 wherein the step of depositing a rhenium metal further comprises depositing through chemical vapor deposition.

18. The method according to claim 14 wherein the step of depositing a rhenium metal further comprises depositing through plasma deposition.

19. The method according to claim 14 wherein the step of depositing a rhenium metal further comprises depositing through electroplating.

20. A composite material comprising:

a carbon substrate defining a surface;

a rhenium/ruthenium alloy interlayer disposed on the carbon substrate surface; and a rhenium coating disposed on the rhenium/ruthenium alloy interlayer.

21. The composite material according to claim 20 wherein the rhenium/ruthenium alloy interlayer is mechanically bonded to the carbon substrate.

22. The composite material according to claim 20 wherein said rhenium/ruthenium interlayer further acts to bond the rhenium coating to the carbon substrate.

23. The composite material according to claim 20 wherein the carbon substrate further defines open areas and wherein the rhenium/ruthenium alloy interlayer is disposed at least partially within the spaces defined by the open areas.

24. The composite material according to claim 20 wherein the rhenium/ruthenium alloy interlayer further defines a first surface in contact with the carbon substrate surface and wherein the rhenium/ruthenium alloy interlayer also defines a second surface and wherein the rhenium layer is deposited on the second surface of the rhenium/ruthenium alloy interlayer.

25. The composite material according to claim 20 wherein said carbon substrate comprises graphite.

26. The composite material according to claim 20 wherein said carbon substrate comprises a carbon-carbon material.

27. The composite material according to claim 20 wherein the rhenium/ruthenium alloy interlayer comprises up to 30 weight per cent ruthenium.

28. A coated valve body comprising:

a carbon substrate defining a surface;

a rhenium/ruthenium alloy interlayer disposed on the carbon substrate surface, and wherein the rhenium/ruthenium alloy interlayer defines a first surface in contact with the carbon substrate surface, and a second surface; and a rhenium coating disposed on the rhenium/ruthenium alloy interlayer second surface.

29. The coated valve body according to claim 28 wherein said carbon substrate further defines pores and wherein said rhenium/ruthenium alloy interlayer is disposed within said pores.

30. The coated valve body according to claim 28 wherein said rhenium/ruthenium alloy interlayer comprises up to 30 weight per cent ruthenium.

31. A rocket nozzle comprising:

a carbon substrate defining a surface;

a rhenium/ruthenium interlayer disposed on the carbon substrate surface; and a rhenium coating disposed on the rhenium/ruthenium interlayer.

32. The rocket nozzle according to claim 31 wherein said carbon substrate further defines pores and wherein said rhenium/ruthenium interlayer is disposed within said pores.

33. The rocket nozzle according to claim 31 wherein said rhenium/ruthenium interlayer comprises up to 30 weight per cent ruthenium.

* * * * *

UNITED STATES PATENT AND TRADEMARK OFFICE

CERTIFICATE OF CORRECTION

PATENT NO. : 7,041,384 B2
APPLICATION NO. : 10/798642
DATED : May 9, 2006
INVENTOR(S) : Donald L. Mittendorf It is certified that error appears in the above-identified patent and that said Letters Patent is hereby corrected as shown below:

Column 10, line 18, “farther” should be changed to --further--.

Signed and Sealed this

Third Day of April, 2007

JON W. DUDAS
*Director of the United States Patent and Trademark Office*